US005795043A

United States Patent [19]

Johnson et al.

[11] Patent Number: 5,795,043

[45] Date of Patent: Aug. 18, 1998

[54] CORROSION-RESISTANT STORAGE CABINET

[75] Inventors: Daryl Johnson; Dennis Johnson; David Johnson, all of Melrose Park, Ill.

[73] Assignee: The Protectoseal Company, Bensenville, Ill.

[21] Appl. No.: 741,787

[22] Filed: Nov. 1, 1996

[51] Int. Cl.[6] ..... A47B 77/06

[52] U.S. Cl. ..... 312/229; 312/257.1; 312/324

[58] Field of Search ..... 312/228, 229, 312/209, 400, 409, 236, 326, 324

[56] References Cited

U.S. PATENT DOCUMENTS

| | | | |
|---|---|---|---|
| 531,956 | 1/1895 | Miller et al. | 312/229 X |
| 620,565 | 3/1899 | Burke et al. | 312/229 X |
| 2,031,283 | 2/1936 | Scofield | 312/229 X |
| 2,161,713 | 6/1939 | Lewis | 312/229 X |
| 2,514,001 | 7/1950 | Knuth | 312/229 X |
| 3,853,367 | 12/1974 | Jamison et al. | 312/257.1 X |
| 4,262,448 | 4/1981 | Flider | 312/324 X |
| 4,344,995 | 8/1982 | Hammer . | |
| 4,729,303 | 3/1988 | Durbin . | |
| 4,780,947 | 11/1988 | Palazzo . | |
| 4,936,377 | 6/1990 | De Vogel et al. | 165/47 |
| 5,028,474 | 7/1991 | Czaplicki . | |
| 5,143,245 | 9/1992 | Malone . | |
| 5,232,119 | 8/1993 | Kauffman . | |
| 5,271,493 | 12/1993 | Hall . | |
| 5,303,840 | 4/1994 | Sharp . | |
| 5,308,423 | 5/1994 | Kauffman . | |
| 5,338,601 | 8/1994 | Brands et al. . | |
| 5,340,208 | 8/1994 | Hauck et al. . | |
| 5,368,670 | 11/1994 | Kauffman . | |
| 5,373,956 | 12/1994 | Kaufer et al. | 312/257.1 X |
| 5,494,183 | 2/1996 | Sharp . | |

OTHER PUBLICATIONS

*The Fisher Catalog*, pp. 1463 and 1468 (1993/1994).

*Lab Safety Supply Catalog*, Janesville, WI, pp. 745, 748–751 (Jan., 1996).

Protectoseal hand–out sheet showing cabinets of the present invention (one page) (1996).

McMaster Catalog "Hazardous Materials Storage Cabinets" pp. 182–189, Dec. 1992.

*Primary Examiner*—Peter M. Cuomo

*Assistant Examiner*—James O. Hansen

*Attorney, Agent, or Firm*—Olson & Hierl, Ltd.

[57] ABSTRACT

A lightweight, structurally strong, corrosion resistant cabinet comprised of plastic and including a bottom sump for storing corrosive materials is provided. The cabinet has a removable bottom shelf beneath which the sump is located for receiving and holding corrosive materials released in the cabinet chamber. Top, bottom, back and side walls, cabinet door(s), and cabinet shelves each have a honeycomb core that is bonded on each opposed face to at least one overlying layer of fiberglass and resin. The cabinet is preferably comprised entirely of corrosion-resistant plastic.

9 Claims, 1 Drawing Sheet

CORROSION-RESISTANT STORAGE CABINET

FIELD OF THE INVENTION

This invention relates to improved cabinets formed of plastic that are suitable for the storage of corrosive materials.

BACKGROUND OF THE INVENTION

Cabinets for storing corrosive materials in corrosion-resistant containers are widely used in laboratory and industrial applications.

Corrosive materials are typically stored in a liquid form although some corrosive materials are stored in a solid or gaseous state. Included among the more widely used corrosive materials are acetic acid, acetic anhydride, bromine, chlorine, fluorine, hydrochloric acid, hydrofluoric acid, nitric acid and other nitrics, potassium hydroxide, sodium hydroxide, sulfuric acid, dichlorics, phenols, phosphoric acid, chromic acid and hydrogen peroxide.

In normal practice, a corrosive material is dispensed from a corrosion-resistant container by manually removing the container from within a storage cabinet, dispensing a quantity of the corrosive material from the container, and returning the container to the cabinet.

Through accident or mistake, however, corrosive material within the container may be released inside the storage cabinet. The corrosive material can eat away at the cabinet and may leak outside.

What is needed is an improved storage cabinet that is structurally strong, corrosion-resistant, and has the capacity to contain corrosive material accidentally released therein. The present invention fulfills this need.

SUMMARY OF THE INVENTION

This invention is directed to a cabinet comprised of plastic which is corrosion-resistant and which can safely contain spilled corrosive liquid and solid materials.

The cabinet structure includes interconnected plastic wall, door and optionally shelf components. Each of these components has a honeycomb core with overlaid layers of resin with glass fiber reinforcement on opposed core sides. Alternating layers of resin and glass fiber-reinforced resin can be employed. The cabinet construction results in a durable, strong and relatively lightweight structure. Further, the plastics used in the cabinet construction are resistant to corrosive materials.

The cabinet includes both a bottom shelf of which at least a part is removable from the cabinet and also an internal bottom, preferably substantially liquid-tight cavity or sump located beneath the bottom shelf. This sump functions to collect and retain (or store) liquid or solid corrosive materials that are released within the cabinet structure, and that drain through aperture means defined in the bottom shelf. The sump thus protects the exterior environmental area about the cabinet from corrosive material release in the cabinet.

Preferably the cabinet has at least one door which allows the bottom shelf to be removed from, and be repositioned within, the cabinet. Thus, convenient access is provided to remove corrosive materials collected within the sump.

Optionally, but preferably, the cabinet also includes at least one medial shelf that is located between the top of the cabinet and the bottom shelf. The medial shelf is preferably removable through a cabinet door to provide ease in cleaning the interior of the cabinet and the sump.

Optionally, but preferably, the exterior surfaces of the cabinet walls, doors and shelves are coated with a corrosion-resistant so-called gelcoat layer.

Preferably, no metal components are present in a cabinet of this invention so that the cabinet structure (including all walls and door(s)) and all cabinet door hinges and latches (if the latter are optionally employed) are comprised of corrosion-resistant plastic.

The inventive cabinet is well adapted for the storage of corrosive materials held in conventional corrosion-resistant containers. The cabinet is corrosion-resistant yet strong, durable and relatively lightweight. In addition, the cabinet has substantial capacity to contain corrosive materials accidentally released therein.

Other and further objects, aims, purposes, features, advantages, embodiments, and the like will be apparent from the present specification, drawings and the appended claims.

DETAILED DESCRIPTION

Figure 1:
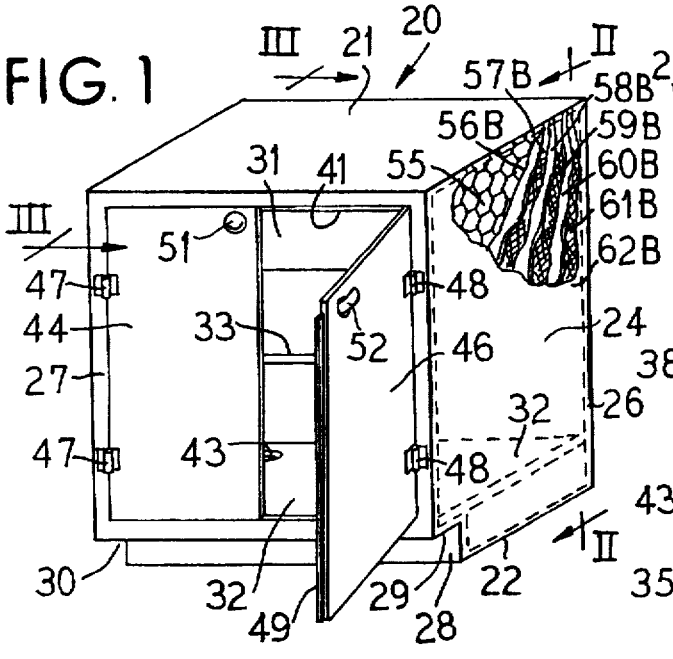
FIG. 1 is a perspective view of one embodiment of corrosion-resistant cabinet of this invention, some parts thereof being broken away and some parts thereof being own in phantom.
Figure 3:
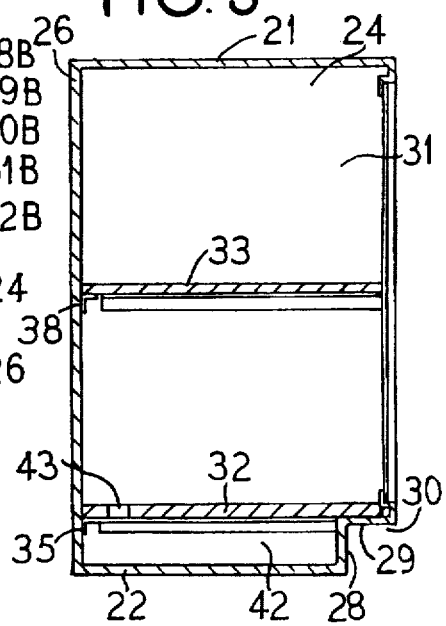
FIG. 3 is a transverse vertical sectional view taken along the line III—III of FIG. 1.
Figure 2:
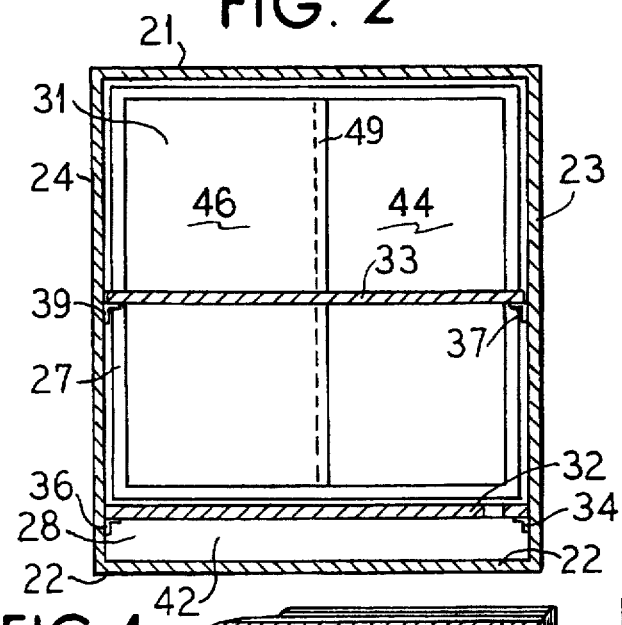
FIG. 2 is a lateral vertical sectional view taken along the line II—II of FIG. 1.

FIGS. 1–6 show one embodiment 20 of the inventive cabinet for storing corrosive materials held in containers (not shown) comprised of suitable corrosion-resistant substances. Cabinet 20 has a structure that includes a top wall 21 and a bottom wall 22 in spaced parallel relationship to each other. Extending from the top wall 21 to the bottom wall 22 is a pair of spaced parallel side walls 23 and 24. Further, the structure of cabinet 20 includes a back wall 26 and a front frame 27 in spaced parallel relationship to each other.

In the structure of cabinet 20, the lower front edge corner of each side wall 23 and 24 is preferably notched to provide a toe cavity or recess 30 that is further defined by a vertical back panel 28 and a horizontal cap panel 29. Each panel 28 and 29 extends laterally between each front bottom notch of the respective side walls 23 and 24 to provide back and top side enclosures for the toe cavity 30. The length of each panel 28 and 29 corresponds to the width of the front frame 27.

Top wall 21, bottom wall 22, side walls 23 and 24, back wall 26, front frame 27, and panels 28 and 29 of cabinet 20 are preferably integrally connected together at and along all abutting and/or overlapping edge portions. The cabinet 20 has an interior chamber 31 that is provided and defined by the walls 21, 22, 23, 24 and 26, the frame 27 and the panels 28 and 29.

Cabinet 20 can be fabricated by any convenient procedure, as those skilled in the art will readily appreciate. In a presently preferred method of construction, the cabinet structure comprised of all walls and including recesses and apertures is made using a two-piece mold. One mold piece is preferably adapted to define the top, bottom and side walls of the cabinet while the second mold piece is preferably adapted to define the front cabinet wall including the door aperture, and the toe recess and front side rails (if present). The two mold pieces preferably cooperatively associate and are preferably provided with interengaging fastening means such as nut and bolt assemblies. When the two mold pieces are engaged in cooperative association, they form a female mold cavity adapted for the forming therein of a desired cabinet structure.

Conveniently and preferably, the interior surfaces of the female mold are sprayed or the like with a conventional coating of a parting film (or release agent) that facilitates removal of a completed portion of a cabinet. The inner surfaces of the female mold define the outer (exterior) cabinet surface portions.

A layer of a gelcoat material is preferably applied to these coated inner mold surfaces preferably by spraying or the like. The gelcoat material is preferably pigmented so as to have a desired color, such as white or otherwise. The term "gelcoat" has generic reference in the plastic forming art to the outer coating that is applied to a reinforced plastic structure comprised of or incorporating a resin that is reinforced with glass fibers or the like. Preferably, for the inventive cabinet, the gelcoat material is a pigmented polyester-based resin. A preferred pigment is white (such as titanium dioxide). Those skilled in the art will readily appreciate that the outer layer of an inventive cabinet structure is applied mainly for cosmetic purposes and preferably provides a smooth, shiny exterior surface. Various resinous coatings can be used to provide such an exterior coating.

Next, at least one layer of a preferably curable, corrosion-resistant resin that is preferably impregnated with reinforcing glass fibers is applied over the resulting surfaces. The glass fibers can comprise a siliceous glass. The glass fiber-reinforced resin in layered form wraps around the corners and abutting edges defined by the mold. Successive layers typically overlap one anther in some areas. Individual layer thickness can vary; a thickness in the range from 1/16" to 1/4" is illustrative, but thicker and thinner layers can be employed.

Next, preformed honeycomb panels each comprised of plastic are positioned in the mold preferably along flat portions of all walls. The plastic honeycomb panels can be variously composed. For example, they can be formed of injection molded, glass fiber-reinforced, cured polyester resin or the like. The thickness of a honeycomb panel can be varied and can be related to the size of a cabinet. For example, and illustratively, for a large cabinet structure, honeycomb panel thickness can be about 1/8", while, for the doors and shelves of such a cabinet, the honeycomb panel thickness can be about 1/4", but thicker and thinner panels can be used.

Next, at least one layer of glass fiber-reinforced, preferably curable resin are applied over the honeycomb panels positioned in the mold. As before, glass fiber reinforced resin layers wrap around the corners and abutting edges defined by the mold and successive layers typically overlap one another in some areas. The wrap around and overlapping layer arrangements are preferably adapted to aid in holding the finished cabinet structure together.

The resulting assembly is allowed to cure and harden in the mold. Preferably the resin(s) used in the layers of glass fiber-reinforced resin employed are adapted to cure at room (ambient) temperatures although some resins do require the application of heat to achieve curing in a practical short period of time.

Once an assembly or construction is hardened, then the mold pieces are separated and slid away from the formed portion of the basic cabinet structure. The cabinet interior typically does not have an applied gelcoat layer.

A maximum corrosion-resistance is preferably obtained from the glass fiber-reinforced cured resin. The gelcoat typically provides fairly good corrosion-resistance properties, but its primary function is cosmetic (that is, to produce a smooth, shiny surface with desired color).

Chamber 31 is illustratively but preferably provided with two shelves consisting of a bottom shelf 32 and an optional but preferred medial shelf 33. Each shelf 32 and 33 preferably has a rectangular or square perimeter configuration. Alternatively, the cabinet 20 can be provided with more or less than two vertically spaced medial shelves, if desired, but characteristically a cabinet 20 always has a bottom shelf 32 that is at least partially removable and preferably completely removable.

Shelves and doors can be fabricated by any convenient procedure using materials similar to those above-described for the cabinet structure. Preferably, a similar molding process to that above-described for making a cabinet structure is followed for making the shelves and the door(s). Preferably, the shelf upper surface portions and the door exterior surface portions are each gelcoated.

Bottom shelf 32 is preferably supported along its respective opposite sides and also along its respective back edge by wall-associated support means, such as elongated right angle brackets 34, 35 and 36. Similarly, and preferably, medial shelf 33 is also supported by right angle brackets 37, 38 and 39.

The shelf brackets of a cabinet can be fabricated by any convenient procedure, but preferably such are fabricated from the same resins that are employed in the basic cabinet structure. While various forming procedures can be used, it is presently preferred to apply a glass fiber-reinforced resin to a mold having the shape of the desired shelf brackets. Once cured (hardened), the brackets are removed from the molds and attached to the sides of the cabinet structure with an appropriate material. Preferably the fastening resin is an epoxy resin putty such as known to those skilled in the art, but other fastening resins can be employed, if desired.

The hinges and (if used) the latches for the doors are conveniently and preferably made by conventional molding or forming (including machining) procedures from plastics such as polycarbonate, acetal or the like, but various other plastics can be employed, if desired. Suitable fastener means for attachment of hinges and brackets can comprise a plastic that is initially fluid and that is usable as an adhesive, such as a nylon, a polyvinylchloride, or the like, such as known to those skilled in the art, but various other fastening means can be employed, if desired.

Each one of the brackets 34–39 is secured at a desired position along its vertically oriented outside face to one of the walls 23, 26 and 24. Thus, the horizontally oriented upper face of brackets 34–36 and of brackets 37–39 are preferably substantially coplanar. The shelves 32 and 33 are each conveniently and preferably inserted into or removed from the chamber 31 through the central open region 41 of front frame 27. The forward lower surface portion of the shelf 32 rests on the upper inside face of cap panel 29. The forward portion of the shelf 33 is not supported. As will be appreciated by those skilled in the art, other various shelf support means can be employed, if desired. However, it is preferred that the shelves 32 and 33 be removable from the cabinet interior chamber 31.

A sump 42 is defined between the bottom shelf 32 and the adjacent bottom wall 22, between the side walls 23 and 24, and between the back wall 26 and the back panel 29. The sump 42 is at the gravitationally lowest region of chamber 31 and provides a pit or tank which receives and temporarily stores any drainage of corrosive material or the like occurring in chamber 31. To facilitate passage of any corrosive material past bottom shelf 32 into sump 42, a drain hole 43 is preferably provided in a back or rear portion of bottom shelf 32. Corrosive material can also drain into sump 42 around the edges of shelf 32. The cabinet 20 is preferably leveled relative to a supporting floor before use.

The front frame 27 is provided with door means for covering (closing) and opening the central aperture 41 therein. Cabinet 20 is illustratively provided with two doors 44 and 46. Each door 44 and 46 is provided with attachment means; here, illustratively such attachment means comprises hinges (paired) 47 for door 44 and hinges (paired) 48 for door 46. Hinges 47 each have one leaf thereof mounted in vertically spaced relationship to each other against one vertically extending side portion of frame 27 while the other (or second) pintle-associated leaf thereof is mounted to an adjacent side edge portion of door 44. Hinges 48 are similarly each mounted to the opposite vertically extending side portion of frame 27 and to an adjacent side edge portion of door 46.

When both doors 44 and 46 are swung to a closed position, they approximately meet centrally and medially preferably in aperture 41 generally along respective adjacent and preferably vertically extending door 44 and 46 side edge portions. Preferably and as shown, each of the doors 46 and 47 is nestably received in the aperture 41 when the doors 44 and 46 are closed. Door 46 has a laterally projecting and vertically extending flange 49 extending along the side edge portion thereof that is adjacent to and overlapping upon the adjacent side edge portion of door 44 (when the doors 44 and 46 are closed). Thus, the adjacent side edge portion of door 44 is adjacent to and transversely forward of flange 49 when both doors 44 and 46 are closed.

Doors 44 and 46 are also each preferably provided with a latch 51 and 52. Any convenient or conventional latch structural arrangement can be employed, such as one consisting of a manually movable bar that fits into a notch (or recess) defined in frame 27 (not detailed). The front frame 27 in combination with doors 44 and 46 and hinges 47 and 48 can be considered to comprise (along with latches 51 and 52, if present) a front wall of the cabinet 20.

The top wall 21, the bottom wall 22, the side walls 23 and 24, the back wall 26, the shelves 32 and 33, and the doors 44 and 46 may each be regarded as "board" components of the cabinet 20. Each is preferably comprised of a honeycomb core panel whose opposed side faces are each bonded to at least one overlying layer of fiberglass and resin. The honeycomb core, the glass fiber reinforcement, and the resin used are each comprised of material that is resistant to corrosive material. The exact structure of such a combination can vary for any given wall, shelf or door "board," as those skilled in the art will readily appreciate. Preferably each "board" is comprised of cured curable resin(s).

Figure 4:
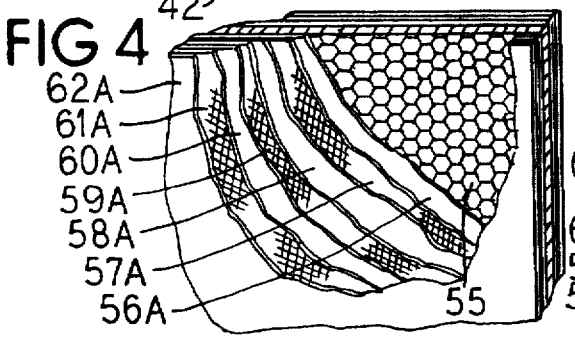
FIG. 4 is a fragmentary, enlarged elevational view of an insi upper corner portion of the right side wall of the embodiment shown in FIG. 1, some parts thereof being broken away.
Figure 5:
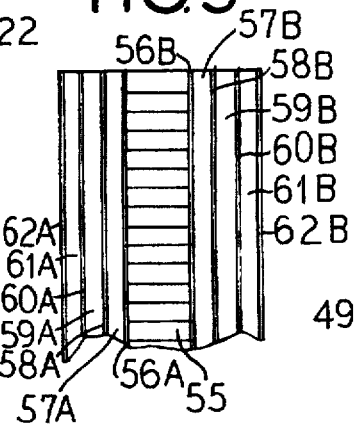
FIG. 5 is a fragmentary enlarged vertical transverse sectional view taken through an upper region of the right side wall of the embodiment shown in FIG. 1.
Figure 6:
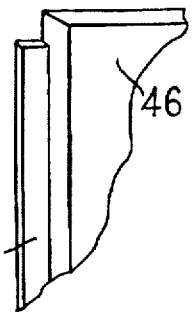
FIG. 6 is as a fragmentary elevational view of the upper left corner of the left cabinet door of the embodiment show in FIG. 1.

One illustrative structure for a wall 24 is illustrated in FIGS. 1, 4 and 5. A preformed honeycomb panel 55 with opposed sides and comprised of plastic has each of its opposed side faces overlaid and bonded first to a layer 56A and 56B, respectively, comprised of resin. Thereafter, a layer 57A and 57B comprised of glass fiber-reinforced resin is overlaid upon each resin layer 56A and 56B, respectively. Each layer 57A and 57B can initially be in the conventional form of a preformed resin impregnated woven cloth (preferred) or random matting. Each layer 57A and 57B can be overlaid with another resin comprised layer 58A and 58B. The resin used in each layer is preferably initially in a liquid form. The amount of resin employed in a glass fiber-reinforced layer is preferably sufficient to impregnate the reinforcing fibers, as those skilled in the art of glass fiber-reinforced plastics will readily appreciate. The procedure is conventionally called "layup."

Preferably, the resin used is curable. After a layup is completed, the resin can be cured. Thereafter, another layup procedural sequence, such as overlaying a glass fiber-reinforced resin layer with an another resin layer, can be repeated.

Various arrangements of layers of resin and of glass fiber-reinforced resin can be used on either side of the honeycomb panels. While the number of such layers on each honeycomb face is typically not more than about five or six layers, a present preference is to employ an average of about two layers on the outside face and about one layer on the inside face of each honeycomb panel; see, for example, FIGS. 1, 4 and 5 where the successive layers are numbered as layers 56 through 62 with A designating layers on one side, and B designating layers on the opposite side, of honeycomb core 55. Shelves and doors can be similarly comprised.

The preferred preparation process herein described is versatile. No high pressure is required.

Because of the expense of the hand labor involved in the layup operations, a so-called "sprayup" preparation procedure can be used alternatively, if desired. A gun, as those skilled in the art appreciate, is commercially available which chops continuous reinforcing glass fibers or the like into approximate one-inch lengths. The chopped fibers are combined with a stream of liquid resin and sprayed directly upon the surfaces of the honeycomb core. Although the random chopped fibers do not reinforce quite as well as woven cloth or random mat, the labor savings are substantial.

In general, glass fiber-reinforced curable plastics (FRPs) are the preferred plastics for use in storage cabinets of this invention. A presently preferred class of plastics comprises vinyl ester resins. Although a starting preformed honeycomb panel is preferably prepared by injection molding or the like, various techniques can be employed for honeycomb fabrication.

Preferably, exterior surfaces are provided with a layer of a corrosive material resistant gelcoat, as indicated above.

Figure 7:
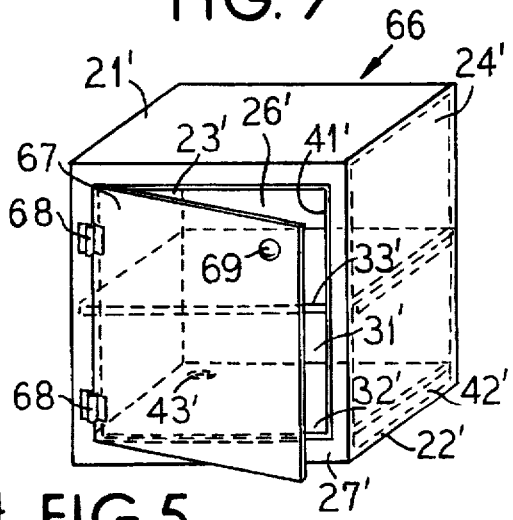
FIG. 7 is a perspective view similar to FIG. 1, but showing an alternative embodiment of a corrosion-resistant cabinet of this invention.

Referring to FIG. 7, there is seen an alternative illustrative embodiment 66 of the inventive storage cabinet structure. Storage cabinet 66 is similar to storage cabinet 20 and corresponding parts are similarly numbered, but with the addition of prime marks thereto for identification purposes.

Storage cabinet 66 has a generally smaller size configuration than storage cabinet 20. Storage cabinet 66 does not incorporate a toe cavity and has only one door 67, but door 67 is equipped with a pair of hinges 68 and a latch 69 analogously to door 46 with its hinges 47 and latch 51. A sump 42' is provided in the cavity between bottom shelf 32' and bottom wall 22'.

Various other embodiments, variations and the like will be apparent to those skilled in the art from the preceding description. No unreasonable or unfair limitations are to be drawn from the foregoing description and accompanying drawings.

what is claimed is:

1. A plastic cabinet for storing corrosive materials comprising in combination:

(a) wall means comprising opposed top and bottom walls, a pair of opposite side walls and opposed front and back walls that define therewithin an interior chamber and that are connected together at all adjoining edge regions;

(b) said front wall comprising a perimetrically extending frame, a central aperture within said frame, and door means for said aperture, said door means including hinge means comprised of plastic and associated with respective portions of said frame and said door means for opening and closing said door means over said aperture;

(c) bottom shelf positionable in said chamber in upwardly spaced, adjacent relationship to said bottom wall, said bottom shelf being insertable into, and removable from, said chamber through said central aperture, said bottom shelf including support means comprised of plastic for supporting said bottom shelf relative to said wall means when said bottom shelf is positioned in said chamber, said bottom shelf when so positioned in said chamber defining therebeneath in combination with adjacent portions of said wall means a sump for receiving and holding corrosive material released in said chamber above said bottom shelf, said bottom shelf including at least one opening through which said released corrosive material can pass from said chamber into said sump;

(d) said wall means, said door means, and said bottom shelf each incorporating honeycomb core means comprised of plastic, each said honeycomb core means having opposed faces, each said face being bonded to at least one layer comprised of glass fiber-reinforced plastic; and (e) said plastic being corrosion resistant.

2. The cabinet of claim 1 wherein said plastic comprises a cured curable resin.

3. The cabinet of claim 1 wherein said door means comprises a single door.

4. The cabinet of claim 1 wherein said door means comprises two doors.

5. The cabinet of claim 4 wherein, each said door pivots on said attachment means about a different generally vertical axis located adjacent one vertical opposite side portion of said frame, and, when both said doors are closed, they meet centrally generally along respective adjacent door side edge portions, each of said doors when closed is nestably received in said aperture, and one of said doors has a laterally projecting and vertically extending flange extending along a side edge portion thereof whereby an opposing adjacent side edge portion of the other of said doors rests adjacent said flange when both said doors are closed.

6. The cabinet of claim 1 which further includes a second shelf that is positioned in said chamber in medially and vertically spaced relationship between said bottom shelf and said top wall, said second shelf including second angle bracket means associated with second shelf adjacent portions of said wall means for supporting said second shelf when positioned in said chamber, said second shelf being insertable into, and removable from, said chamber through said central aperture, said second shelf being comprised of honeycomb core means having opposed faces that are each bonded to at least one overlying layer comprised of fiberglass and resin, said resin and said fiberglass being resistant to corrosive material.

7. The cabinet of claim 1 wherein a toe cavity is defined therein.

8. The cabinet of claim 7 wherein said frame has a lower laterally extending bottom portion and each of said side walls has a lower front corner region, said toe cavity is located below said lower laterally extending bottom portion of said frame, the depth and height of said top cavity are each defined by a notch formed in said lower front corner region of each of said side walls, and a rear vertical wall and an upper horizontal wall of said toe cavity are each provided by a different longated panel, whereby one side wall of said sump is defined by said rear vertical wall.

9. A cabinet for storing corrosive materials comprising in combination:

(a) wall means comprising opposed top and bottom walls, a pair of opposite side walls and opposed front and back walls that define therewithin an interior chamber, said wall means each having edge regions;

(b) connection means for connecting together all adjoining said edge regions;

(c) said front wall comprising a perimetrically extending frame, and a central aperture defined within said frame;

(d) door means for said aperture;

(e) hinge means including joining means for joining said hinge means with adjacent respective portions of said frame and said door means for pivotably opening and closing said door means relative to said frame over said aperture;

(f) bottom shelf positionable in said chamber in upwardly spaced, adjacent relationship to said bottom wall, said bottom shelf being insertable into, and removable from, said chamber through said central aperture;

(g) support means for supporting said bottom shelf relative to adjacent portions of said wall means when said bottom shelf is positioned in said chamber;

(h) said bottom shelf, when so positioned in said chamber, defining therebeneath in combination with adjacent portions of said wall means a sump for receiving and holding corrosive material released in said chamber above said bottom shelf;

(i) said bottom shelf including therein at least one opening through which said released corrosive material can pass from said chamber into said sump;

(j) said wall means, said door means, and said bottom shelf each incorporating honeycomb core means, each said honeycomb core means having opposed faces;

(k) each said opposed face being bonded to at least one facing layer means comprised of glass fiber-reinforced plastic; and (l) said connection means, said hinge means, said support means, said honeycomb core means, and said facing layer means each being comprised of corrosion resistant plastic, and said facing layer means being glass fiber reinforced.

* * * * *